United States Patent [19]

Gray et al.

[11] 4,193,650

[45] Mar. 18, 1980

[54] ADJUSTABLE SHELF DEVICE

[75] Inventors: James A. Gray, Edina; Randall V. Lindfors, Minneapolis, both of Minn.

[73] Assignee: Zero-Max Industries, Inc., Minneapolis, Minn.

[21] Appl. No.: 925,949

[22] Filed: Jul. 19, 1978

[51] Int. Cl.[2] ..... A47B 45/00

[52] U.S. Cl. ..... 312/205; 312/108; 312/111; 312/257 R; 108/92

[58] Field of Search ..... 312/257 R, 257 SK, 257 SM, 312/257 A, 107, 108, 111, 205; 211/153; 108/92, 93

[56] References Cited

U.S. PATENT DOCUMENTS

| | | | |
|---|---|---|---|
| 1,069,411 | 8/1913 | Greene | 312/205 |
| 1,282,833 | 10/1918 | Holder | 312/257 R |
| 2,721,632 | 10/1955 | Surpierre | 312/257 R |
| 2,789,700 | 4/1957 | King et al. | 108/92 |
| 3,069,216 | 12/1962 | Vaeth | 312/257 R |
| 3,272,581 | 9/1966 | Stucki | 312/257 R |
| 3,464,372 | 9/1969 | Fiterman et al. | 312/111 |
| 3,741,450 | 6/1973 | Seastrom | 312/111 |
| 3,784,273 | 1/1974 | Nikolai | 312/257 R |
| 3,807,572 | 4/1974 | Luvara et al. | 312/108 |
| 4,025,137 | 5/1977 | Wyler | 312/205 |

*Primary Examiner*—Victor N. Sakran

*Attorney, Agent, or Firm*—Williamson, Bains, Moore & Hansen

[57] ABSTRACT

An adjustable shelf device is used with a conventional filing cabinet, shelving or the like to readily form the cabinet space into various sized compartments to thereby permit efficient use of the cabinet space. The shelf device includes a pair of shelf structures which have overlapping vertical and horizontal shelves that are longitudinally shiftable relative to each other to permit adjustment of the overall length of the shelf device to thereby accommodate cabinets or shelving of various sizes. Vertical dividers project into registering openings in the overlapped portions of the shelf structure to releasably lock the shelf device in an adjusted position.

7 Claims, 5 Drawing Figures

ADJUSTABLE SHELF DEVICE

SUMMARY OF THE INVENTION

This invention relates to a shelf device and more particularly, to an adjustable shelf device which is effective in permitting the shelf space of filing cabinets and the like to be readily formed into compartments of various sizes.

There are many commercially available filing cabinets, shelving devices and the like, but these structure often lack compartments which are really necessary for efficient filing and retrieval of papers and things.

It is therefore a general object of this invention to provide a novel shelf device, of simple and inexpensive construction, for use with conventional filing cabinets shelving or the like which permits the formation of various size compartments and thereby increase the efficiency of the cabinet and shelving space.

Another object of this invention is to provide a shelf device for use with filing cabinets and the like, the shelf device being longitudinally adjustable to accommodate various sized cabinets and serving to permit the cabinet space to be readily compartmentalized.

These and other objects and advantages of this invention will more fully appear from the following description made in connection with the accompanying drawings, wherein like reference characters refer to the same or similar parts throughout the several views.

FIGURES OF THE DRAWINGS

DESCRIPTION OF THE PREFERRED EMBODIMENT OF THE INVENTION

Figure 1:
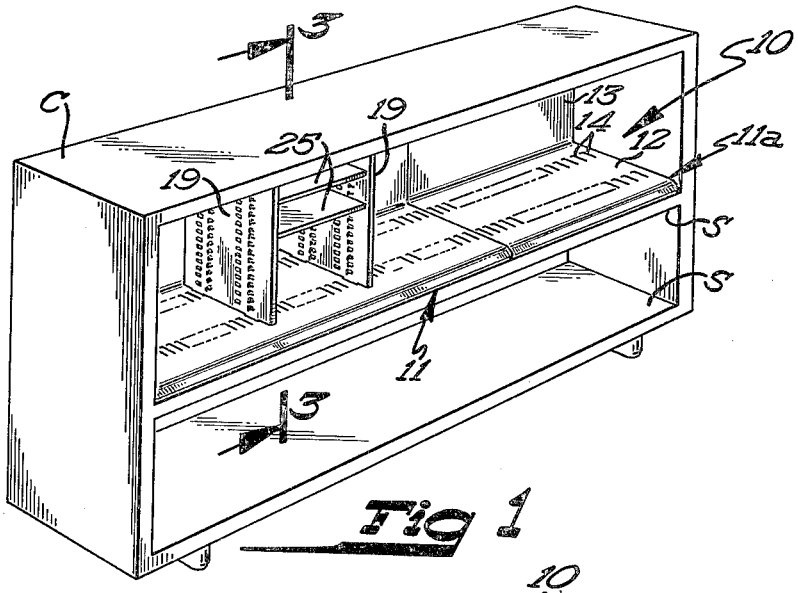
FIG. 1 is a perspective view of my novel shelf device illustrated in use with a conventional filing cabinet.

Referring now to the drawings, and more particularly to FIG. 1, it will be seen that my novel shelf device 10 is illustrated in cooperative relation with a conventional cabinet C. In this respect, it will be noted that the cabinet C is provided with horizontal shelves S to thereby form the cabinet into rather large compartments. Cabinets, such as the cabinet C, are typically used as filing structures to accommodate papers, documents and the like but the lack of compartments renders such filing cabinets inefficient for effective filing and retrieval of documents and things.

The novel shelf device 10 serves to form the cabinet space into compartments for effective filing and retrieval of documents and the like. The shelf device 10 includes a pair of similar shelf structures 11 and 11*a*. The horizontal shelf structure 11 is comprised of a generally rectangular shaped, flat, horizontal shelf member 12 and a generally rectangular shaped substantially flat vertical shelf member 13 integrally formed with the rear edge of the horizontal shelf member 12 and projecting vertically upwardly therefrom.

Figure 2:
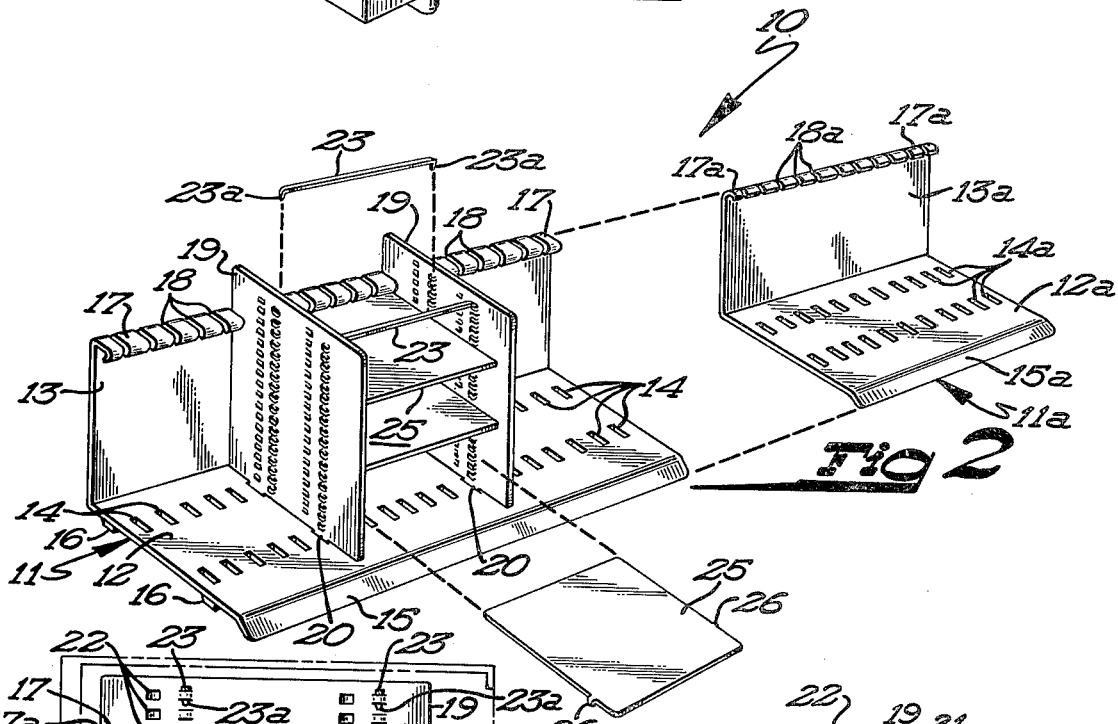
FIG. 2 is a partially exploded perspective view of the novel shelf device illustrating the details of construction thereof.

The horizontal shelf member 12 has a plurality of transversely extending slots 14 therein, the slots 14 being arranged in a pair of longitudinally extending laterally, spaced-apart rows, as best seen in FIG. 2. The front edge portion of the horizontal shelf member 12 is slanted downwardly and forwardly as at 15, and the horizontal shelf member 12 is provided with a plurality of foot elements 16 which support the horizontal shelf member above the surface of the shelf S of the cabinet C. The vertical shelf member 13 has its upper portion 17 which is bent forwardly, then downwardly and rearwardly. This bent edge portion 17 has a plurality of openings or slots 18 therein.

The shelf structure 11*a* is also comprised of a generally rectangular shaped horizontal shelf member 12*a* having a generally rectangular shaped vertical shelf member 13*a* integrally formed and projecting upwardly from the rear longitudinal edge thereof. The horizontal shelf member 12*a* also has a plurality of slots 14*a* therein which are arranged in transversely spaced longitudinally extending rows in the manner of the shelf member 12. The front edge portion 15*a* of the horizontal shelf member 12*a* is slanted downwardly and forwardly, and the horizontal shelf member 12*a* is also provided with a plurality of foot elements (not shown) at one end thereof. Similarly, the upper edge portion 17*a* of the vertical shelf member 13*a* is bent forwardly and downwardly. The bent portion 17*a* is provided with a plurality of longitudinally spaced-apart slots 18*a* therein.

The shelf structures 11 and 11*a* are disposed in overlapped, sliding engagement, so that the horizontal shelf member 12*a* is positioned upon the horizontal shelf member 12 and the vertical shelf member 13*a* is positioned forwardly of the vertical shelf member 13. The bent upper edge portion 17*a* of the vertical shelf member 13*a* is positioned interiorly of the bent edge portion 17 of the shelf member 13. With this arrangement, the overall length of the shelf device 10 can be readily adjusted by sliding the shelf structures longitudinally with respect to each other.

The shelf device 10 also includes a plurality of generally rectangular shaped substantially, flat vertical dividers 19 each having a pair of generally rectangular shaped tabs 20 integral with and projecting downwardly from the lower edges thereof. It will be noted that the spacing between the tabs 20 on each vertical divider corresponds to the spacing between rows of slots 14 and 14*a* in the horizontal shelf members.

Figure 3:
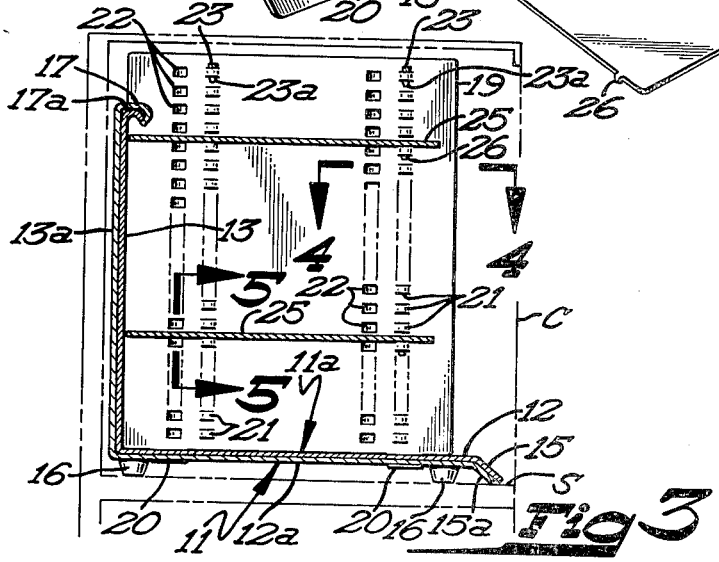
FIG. 3 is a cross-sectional view taken approximately along line 3—3 of FIG. 1 and looking in the direction of the arrows.
Figure 4:
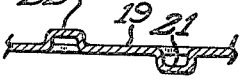
FIG. 4 is a cross-sectional view taken approximately along line 4—4 of FIG. 3 and looking in the direction of the arrows.
Figure 5:
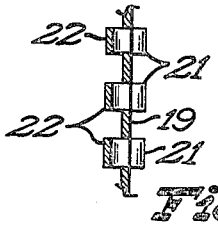
FIG. 5 is a cross-sectional view taken approximately along line 5—5 of FIG. 3 and looking in the direction of the arrows.

The vertical dividers 19 are adapted to be positioned upon the horizontal shelf members 12 and 12*a* so that the tabs 20 project downwardly into the slots 14 and 14*a*. The rear edge portions of the vertical dividers 19 also project into the slots 18 and 18*a* in the edge portions 17 and 17*a* of the vertical shelf members 13 and 13*a*. The vertical dividers 19 cooperate with the horizontal and vertical shelf members of each shelf structure to form compartments which may be selectively varied in size. It will also be noted that each vertical divider is provided with a plurality of laterally struck U-shaped tabs 21 which are arranged in transversely spaced apart vertically extending rows as best seen in FIG. 3. The tabs 21 are struck outwardly from one surface of each vertical divider. Each vertical divider 19 is also provided with a plurality of laterally struck U-shaped tabs 22 which are arranged in transversely spaced apart vertically extending rows and which are struck outwardly from the other surface of each vertical divider.

Means are also provided for stabilizing the forward portions of a pair of adjacent vertical dividers 19 and this means includes an elongate substantially straight stabilizer bar 23 having downturned ends 24. The downturned ends 24 are adapted to be inserted into the openings defined by the U-shaped struck tab 21 on one vertical divider 19 and a tab 22 on an adjacent vertical divider. The stabilizer bar stabilizes the forward portion of the vertical dividers and cooperates with the slots 18 and 18*a* to maintain the vertical dividers in substantially parallel relation.

The shelf device 10 also includes a plurality of generally rectangular shaped substantially flat horizontal dividers 25 each having a tab 26 formed on each longitudinal edge thereof. The horizontal dividers 25 are adapted to be supported on the tabs 21 and 22 of the adjacent vertical dividers, and the down struck tabs 26 on the horizontal dividers are adapted to be inserted into the opening defined by the U-shaped tabs 21 and 22. The horizontal dividers further divide the space formed by a pair of vertical dividers into additional compartments. Thus, it will be seen that through the use of the horizontal and vertical shelf members of each shelf structure and the use of the vertical and horizontal dividers, the shelf device may be readily formed into various sized compartments for accommodating documents and articles.

In use, the shelf device will be adjusted with respect to its overall length to accommodate the length of a shelf of a cabinet or the like. In this respect, the shelf structures 11 and 11*a* will be shifted relative to each other to lengthen or shorten the overall length of the shelf device as desired. When the shelf structures 11 and 11*a* have been adjusted longitudinally with respect to each other, certain slots 14 of the horizontal shelf member will be disposed in registering relation with slots 14*a* on the shelf member 12*a*. Similarly, certain slots 18 of the vertical shelf member 13 will be disposed in registering relation with certain slots 18*a* of the vertical shelf member 13*a*. A vertical divider 19 will have its tabs 20 project downwardly into the registering slots 14 and 14*a* and the rear edge portions of the divider will be projected into the registering slots 18 and 18*a*.

Thus, the vertical divider serves to releasably lock the shelf structures in an adjusted position. A plurality of vertical dividers will be applied to the shelf structures 11 along with horizontal dividers 25 to thereby form the shelf device 10 into various sized compartments as desired. Stabilizer bars 23 will be applied to each adjacent pair of vertical dividers to stabilize the forward portions of the dividers. The various compartments formed by the horizontal and vertical dividers may be readily changed by the user anytime to form compartments of different size. The longitudinal adjustability of the shelf device 10 allows the shelf device to be used with substantially any conventional size filing cabinet, shelving or the like.

From the foregoing, it will be seen that I have provided a novel adjustable shelf device which is effective in forming cabinet space into a plurality of efficient filing compartments to thereby permit filing and retrieval of documents and things.

Thus, it will be seen that I have provided a novel shelf device, which is not only of simple and inexpensive construction, but one which functions in a more efficient manner than any heretofore known comparable device.

What is claimed is:

1. A longitudinally, adjustable shelf device, comprising:

a pair of elongate shelf structures each including a horizontal shelf member and a vertical shelf member integral with a longitudinal edge of the associated horizontal shelf member and being disposed in substantially right angular relationship thereto, the horizontal and vertical shelf structure being disposed in overlapped relation respectively with the horizontal and vertical shelf members of the other shelf structure, each of said vertical shelf members having an offset portion extending longitudinally thereof, said offset portion of each vertical shelf member having a plurality of longitudinally spaced apart openings therein, said shelf structure being longitudinally adjustable relative to each other to thereby adjust the overall length thereof, each shelf structure having a plurality of longitudinally spaced apart openings therein, each opening in the overlapped portion of one shelf structure being disposed in registering relation with an opening in the overlapped portion of the other shelf structure, a plurality of substantially flat, rigid, vertical dividers each projecting into an opening in a vertical shelf member to orient each divider into vertical relation, and secure the latter to the shelf structure.

2. A shelf device as defined in claim 9 and stabilizing means engaging adjacent pair of vertical dividers to releasably retain each adjacent pair of vertical dividers in substantially parallel relation.

3. The shelf device as defined in claim 9 and a plurality of foot elements on each of said horizontal shelf members to space the shelf members vertically above the horizontal support surface of the cabinet.

4. The shelf device as defined in claim 7 wherein said horizontal shelf members of each shelf structure has a forward edge portion which extends downwardly and forwardly from the general plane of the horizontal shelf members.

5. A longitudinally, adjustable shelf device, comprising:

a pair of elongate shelf structures, each shelf structure including a horizontal shelf member, and a vertical shelf member integral with a longitudinal edge of the associated horizontal shelf member and being disposed in substantially right angular relationship thereto, the horizontal and vertical shelf members of one shelf structure being disposed in overlapped relation respectively with the horizontal and vertical shelf members of the other shelf structure, said shelf structures being longitudinally adjustable relative to each other to thereby adjust the overall length thereof, each vertical shelf member having an offset portion extending longitudinally throughout the length thereof, said offset portion of each vertical shelf member having a plurality of longitudinally spaced apart openings therein, each opening in the overlapped portion of one shelf structure being disposed in registering relation with an opening in the overlapped portion of the other shelf structure.

a plurality of substantially flat, rigid, vertical dividers each projecting into an opening in a shelf structure to orient each divider in vertical relation, at least one of the vertical dividers projecting into registering openings in the overlapped portions of the vertical shelf members to thereby lock the shelf structures against longitudinal movement.

6. The shelf device as defined in claim 5 wherein the upper longitudinal edge portion of each vertical shelf member is forwardly bent to define said offset portion.

7. The shelf device as defined in claim 4 wherein each of said horizontal shelf members has a plurality of openings therein arranged in transversely spaced apart, longitudinally extending rows, said vertical dividers having tabs integral with the lower edge thereof extending into a pair of openings in the associated horizontal shelf members.

* * * * *

UNITED STATES PATENT AND TRADEMARK OFFICE

CERTIFICATE OF CORRECTION

PATENT NO. : 4,193,650

DATED : March 18, 1980

INVENTOR(S) : James A. Gray and Randall V. Lindfors

It is certified that error appears in the above–identified patent and that said Letters Patent are hereby corrected as shown below:

In the Claims:

Column 4, Claim 2, line 30, change"claim 9" to --claim 1--.

Column 4, Claim 3, line 34, change "claim 9" to --claim 1--.

Column 4, Claim 4, line 38, change "claim 7" to --claim 3--.

Signed and Sealed this

*Third* Day of *March 1981*

[SEAL]

*Attest:*

RENE D. TEGTMEYER

*Attesting Officer*

*Acting Commissioner of Patents and Trademarks*